US008931879B2

(12) United States Patent
Nystrom et al.

(10) Patent No.: US 8,931,879 B2
(45) Date of Patent: Jan. 13, 2015

(54) LASER TRANSMISSION LAMINATING OF MATERIALS FOR INK JET PRINTHEADS

(75) Inventors: Peter J Nystrom, Webster, NY (US); Mark A. Cellura, Webster, NY (US); Bijoyraj Sahu, Gainsville, NY (US)

(73) Assignee: Xerox Corporation, Norwalk, CT (US)

( * ) Notice: Subject to any disclaimer, the term of this patent is extended or adjusted under 35 U.S.C. 154(b) by 408 days.

(21) Appl. No.: 13/401,061

(22) Filed: Feb. 21, 2012

(65) Prior Publication Data

US 2013/0215185 A1 Aug. 22, 2013

(51) Int. Cl.
*B41J 2/015* (2006.01)

(52) U.S. Cl.
USPC ..... 347/20

(58) Field of Classification Search
USPC ..... 347/20
See application file for complete search history.

(56) References Cited

U.S. PATENT DOCUMENTS

2011/0141204 A1* 6/2011 Dolan et al. ..... 347/71

OTHER PUBLICATIONS

Bonding Mechanisms of Laser Fabricated Titanium/Polyimide and Titanium Coated Glass/Polyimide Microjoints, Mian et al., Surf. Interface Anal. 2007; 39:506-511.
Experimental Studies on Laser-Based Hot-Melt Bonding of Thermosetting Composites and Thermoplastics, Amend et al., Physics Procedia 12,2011.
Laser Bonding of Glass to Silicon Using Polymer for Microsystems Packaging, Bardin et al., Journal of Microelectromechanical Systems, vol. 6, No. 3, Jun. 2007.
Adhesion Enhancement and Lamination of Polyimide Films, Stoffel et al.,IEEE Transactions on Components, Packaging and Manufacturing Technology, vol. 19, No. 2, 1996.

* cited by examiner

*Primary Examiner* — Laura Martin
(74) *Attorney, Agent, or Firm* — MH2 Technology Law Group LLP

(57) ABSTRACT

A method for assembling a printhead such as an ink jet printhead can include the use of a laser to bond two or more printhead layers together. In an embodiment, a laser beam is directed through a transparent layer to an energy-absorbing layer, where the energy-absorbing layer is melted such that after removal of the laser beam the melted layer solidifies to adhere the energy-absorbing layer to the transparent layer. In another embodiment, heating the energy-absorbing layer melts the transparent layer to adhere the energy-absorbing layer to the transparent layer after removal of the laser beam. The laser transmission lamination process described can result in a fluid-tight seal which requires less processing time and materials over an adhesive-based process.

10 Claims, 4 Drawing Sheets

LASER TRANSMISSION LAMINATING OF MATERIALS FOR INK JET PRINTHEADS

FIELD OF THE EMBODIMENTS

The present teachings relate to the field of printing devices, and more particularly to printing devices including printheads such as ink jet printheads.

BACKGROUND OF THE EMBODIMENTS

Printing an image onto a print medium such as paper for consumer and industrial use is dominated generally by laser technology and ink jet technology. Ink jet technology has become more common as ink jet printing resolution and print quality have increased. Ink jet printers typically use either thermal ink jet technology or piezoelectric technology. Even though they are more expensive to manufacture than thermal ink jets, piezoelectric ink jets are generally favored, for example, because they can use a wider variety of inks.

Piezoelectric ink jet printheads typically include a flexible diaphragm manufactured from, for example, stainless steel. Piezoelectric ink jet printheads can also include an array of piezoelectric transducers (i.e., actuators) attached to the diaphragm. Other printhead structures can include one or more laser-patterned dielectric standoff layers and a flexible printed circuit (flex circuit) or printed circuit board (PCB) electrically coupled with each transducer. A printhead can further include a body plate, an inlet/outlet plate, and an aperture plate, each of which can be manufactured from stainless steel. The aperture plate includes a plurality of nozzles (i.e., one or more openings, apertures, or jets) through which ink is dispensed during printing.

During use of a piezoelectric printhead, a voltage is applied to a piezoelectric transducer, typically through electrical connection with a flex circuit electrode electrically coupled to a voltage source, which causes the piezoelectric transducer to bend or deflect, resulting in a flexing of the diaphragm. Diaphragm flexing by the piezoelectric transducer increases pressure within an ink chamber and expels a quantity of ink from the chamber through a particular nozzle in the aperture plate. As the diaphragm returns to its relaxed (unflexed) position, it reduces pressure within the chamber and draws ink into the chamber from a main ink reservoir through an opening to replace the expelled ink.

The complex three-dimensional microfluidic channels (ink ports) for ink jet printheads can be fabricated by assembling a plurality of layers which can include a number of different materials such as one or more laser patterned polymers, etched stainless steel layers, and aluminum layers. The manufacturing process can include stacking the layers within a press and applying high pressure and temperature. A plurality of adhesive films are used to effect bonding of the material layers together. An adhesive cure cycle can require the application of the pressure and temperature on the layer stack within the press for an extended duration of time, for example two hours, to minimize delamination of the layers and premature failure of the printhead during use. The adhesives which bond the various printhead layers together are formulated for both their bonding reliability and their compatibility with solid and ultraviolet inks.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment for forming a printer subassembly can include forming an ink jet printhead using a method comprising placing an energy-absorbing layer in physical contact with a transparent layer, directing a laser beam through the transparent layer to contact the energy-absorbing layer with the laser beam, and curing at least one of the energy-absorbing layer and the transparent layer to physically attach the energy-absorbing layer to the transparent layer.

Another embodiment can include a printer subassembly having an ink jet printhead, wherein the ink jet printhead includes an energy-absorbing layer and a transparent layer connected to the energy-absorbing layer using a laser-cured material, wherein the laser-cured material physically contacts the energy-absorbing layer and the transparent layer.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

Figure 1:
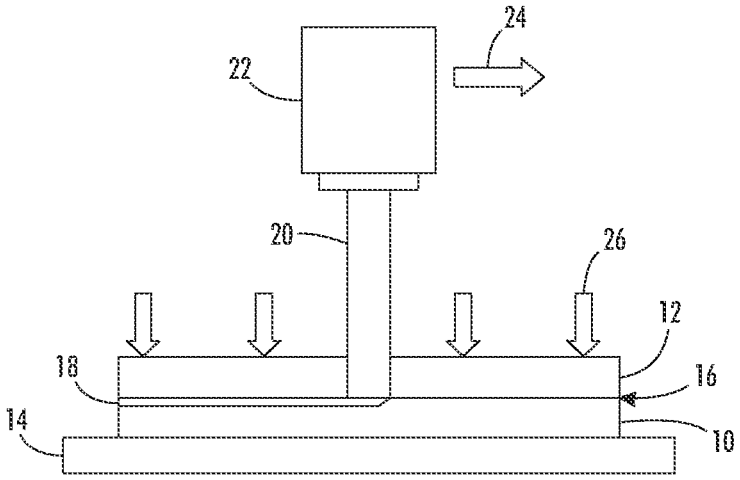
FIG. 1 is a cross section depicting laser bonding of two layers in accordance with an embodiment of the present teachings.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the exemplary embodiments of the present teachings, examples of which are illustrated in the accompanying drawings. Wherever possible, the same reference numbers will be used throughout the drawings to refer to the same or like parts.

As used herein unless otherwise specified, the word "printer" encompasses any apparatus that performs a print outputting function for any purpose, such as a digital copier, a bookmaking machine, a facsimile machine, a multi-function machine, a plotter, etc.

The word "polymer" encompasses any one of a broad range of carbon-based compounds formed from long-chain molecules including thermosets, thermoplastics, resins such as polycarbonates, epoxies, and related compounds known to the art.

The term "transparent" is used herein to describe a layer through which at least a portion of energy from a laser beam at a specific wavelength can pass without absorbing all the energy. The energy which passes through the transparent layer can be transferred to an underlying layer which absorbs the energy. A transparent layer can be visually transparent, semi-transparent, or opaque, but will be transparent to a laser beam at one or more wavelengths. Some laser energy can be absorbed by the transparent layer as long as the amount of energy absorbed does not unduly adversely affect the laser bonding process.

The term "cured" is used herein to describe a layer which has been altered to provide a completed adhesive layer. A cured layer can be a layer which has been melted and cooled to provide adhesion of the cured layer to another layer. A cured layer can also be a layer interposed between two other layers which physically connects the two other layers. A cured layer can further be a liquid or paste adhesive such as a UV-curable adhesive which has been cured with UV light or a heat-curable adhesive which has been cured by heat.

As discussed above, an assembled stack of ink jet printhead layers can be placed within a heated press to cure conventional adhesives during printhead manufacture. Relatively long processing times are needed to cure the adhesive, for example two hours or more, at relatively high temperatures and pressures, for example 300° C. and 300 psi. High temperatures required for curing the adhesive can damage other printhead structures such as silicon-based structures, and reduce the thermal budget available for subsequent processing. Additionally, the layer stack can include patterned standoffs which are used to contain the liquid adhesive to ensure that it does not flow away from desired areas which can result in contamination, blocked ink ports, and a malfunctioning printhead. Patterned standoffs can be expensive, require precise placement, and add to the cost of manufacture. Further, the characteristics of two different materials can make their physical connection difficult, such that an adhesive cannot be used to reliably connect the two materials together. Attempts to physically connect the materials with a conventional adhesive can result in delamination of the two materials and failure of the printhead.

Reducing assembly time and the number of materials required to form a printhead can decrease manufacturing costs and process complexity. Further, new ways of connecting two different materials can result in more materials available for printhead formation.

In various embodiments of the present teachings, a laser bonding process can be used to physically connect two or more layers. The use of a laser bonding process in ink jet printhead manufacture presents particular challenges. For example, channels for routing ink through the printhead to nozzles in a printhead aperture plate result in uneven heating of the printhead layers during a laser bonding process. The uneven heating can damage microchannels due to heat flow away from the laser path. The laser bonding technique must also provide complete lamination of the print head layers without any leak paths for the inkjet fluid.

The laser process and techniques described below are specifically suited for bonding of multiple stack of inkjet printhead layers. In various embodiments of the present teachings, two or more printhead layers can be physically attached to each other using a laser lamination process. Use of an embodiment of the present teachings can reduce the number of materials used, for example by eliminating the need for an adhesive layer to physically connect two layers together. In another embodiment, a particular laser-cured adhesive layer can be interposed between two layers, wherein the two layers are materials which previously were incompatible can could not be physically connected reliably using conventional adhesives.

FIG. 1 is a cross section depicting an embodiment of the present teachings. In this embodiment, a jet stack including at least a first layer 10 and a second layer 12 can be placed onto an insulated base plate 14. An interface 16 between the first layer 10 and the second layer 12 is targeted for laser bonding such that, after laser lamination, the first layer 10 is bonded to the second layer 12 with a sealed, fluid-tight bond 18.

In an embodiment, the first layer 10 can be a material which can absorb energy from a laser beam 20 output by a laser 22, while the second layer 12 can be a transparent layer through which a laser beam 20 can pass with reduced energy transfer to the second layer 12. Laser energy absorbed by layer 10 is sufficient to melt at least an upper surface of layer 10 to provide the fluid-tight bond 18. After the laser beam no longer contacts an area of layer 10, the melted portion of layer 10 cools and physically bonds layer 10 to layer 12.

An energy-absorbing layer can be made less transparent (i.e., more energy absorbent) by adding a dye to the energy-absorbing layer. The dye selected can be tailored for the laser wavelength such that energy absorption by the energy-absorbing layer is improved. Further, a laser-opaque coating can be applied to a bottom surface of the transparent layer or to either the top surface or bottom surface (or both) of the energy-absorbing layer to enhance the energy-absorbing qualities of either the transparent layer or the energy-absorbing layer. The dye or coating can limit laser penetration to a depth of interest to result in increased energy absorption from the laser. The increased laser energy absorption by the die or coating thereby heats a layer at the depth of interest to increase the temperature within the layer to sufficient level to create the necessary heat for fusion at a temperature which is at or above the melting point of the layer 10 which absorbs energy.

In an embodiment, the laser beam can be scanned 24 during laser bonding. For purposes of this disclosure, "scanning" the laser beam refers to the movement of the laser beam relative to the layer to be bonded. The laser beam, the layer to be bonded, or both can be moved to effect scanning. Scanning the laser beam can result in a bond line which is longer than the width of the laser beam and can be used to form fluid-tight bonds between layers to seal the ink channels. The scanning speed will depend, for example, on the thickness and transparency of the transparent layer 12, the energy output of the laser beam 20, and the characteristics of the energy-absorbing layer 10. A thicker transparent layer 12 may diffuse the laser beam more than a thinner layer, decrease focus of the laser beam, and spread the energy over a wider area, and thus a decreased scanning speed will be needed for a given laser beam for a thicker transparent layer than for a thinner transparent layer. A higher energy laser beam can have a higher scan speed than a lower energy beam for lasers with the same beam width. An energy-absorbing layer which absorbs energy at a higher efficiency can have a higher scan speed than an energy-absorbing layer which is less efficient at energy absorption.

In an embodiment, a plurality of individual laser pulses can be used to form individual points of melted layer 10. The individual points of melted layer 10 can be overlapped to form the fluid-tight seal 18. In another embodiment, continuous scanning of the laser can be combined with an overlap between individual scans to form a fluid-tight seal 18.

In an embodiment, the energy-absorbing first layer 10 can be a layer which absorbs laser energy at a sufficient efficiency such that it can reach its melting point through the use of laser energy. Energy-absorbing layer 10 can be, for example, a thermoplastic layer or a polymer layer such as a polyimide. As discussed above, layer 10 can include a pigment, dye, or coating which enhances laser energy absorption. Transparent layer 12 can be a material which is similar to that of layer 10, for example thermoplastic or polymer, and can include a pigment which enhances laser energy transparency. Thus the two layers 10, 12 can be the same base material with different energy absorption characteristics which have been tailored using pigments, dyes, or coatings. Any dye, pigment, or coating can generally be customized for a laser wavelength to be used for bonding.

In another embodiment, energy-absorbing layer 10 can be a metal layer, for example stainless steel, while transparent layer 12 is a synthetic layer such as polymer or thermoplastic. In an embodiment, laser beam 20 impinges on and heats energy-absorbing layer 10 to a sufficient temperature such that heat from energy-absorbing layer is transferred to transparent layer 12. The energy is transferred to transparent layer 12 through physical contact of layer 12 with layer 10, and is sufficient to melt transparent layer 12. In this embodiment, structure 18 represents the portion of layer 10 which has been heated to a sufficient temperature to melt layer 12. Upon removal of the laser beam 20 from a heated area of layer 10, the melted portion of layer 12 cures by cooling to physically bond layer 12 with layer 10 to provide a fluid-tight seal.

Bonding between two layers may be most efficient which the surfaces of the two layers which contact each other are clean and smooth. A smooth stainless steel surface can be cleaned prior to attachment of a synthetic layer to provide a better bond using a chemical cleaning process.

During the process represented by FIG. 1, a clamping force 26 can be used to assist in holding layer 12 in physical contact with layer 10 during laser bonding to reduce or eliminate voids between layer 10 and layer 12. To establish a fluid-tight seal 18, no voids should exist between layer 10 and layer 12 in the area of the seal 18. A clamping force 26 of between about 10 psi and about 300 psi, or between about 20 psi and about 200 psi, or between about 30 psi and about 100 psi during the laser bonding process may be sufficient to provide good physical contact between the two layers 10, 12 to reduce or eliminate voids between the two layers subsequent to bonding.

Figure 2:
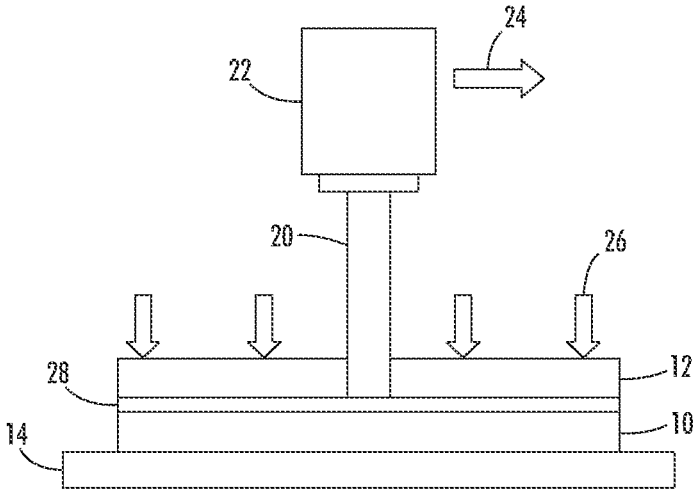
FIG. 2 is a cross section depicting laser bonding of two layers in accordance with another embodiment of the present teachings.

FIG. 2 depicts another embodiment of the present teachings which includes a heat-flowable adhesive layer 28 interposed between and contacting an underlying layer 10 and an overlying transparent layer 12. In this embodiment, heat-flowable adhesive layer 28 is a layer which absorbs energy from a laser beam 20 directed onto the layer 28, while layer 12 is transparent or semi-transparent to laser beam 20. During lamination, laser beam 20 passes through transparent layer 12 and contacts heat-flowable layer 28. Heat-flowable layer 28 melts and, upon removal of laser beam 20, solidifies (cures) to provide a physical attachment between underlying layer 10 and transparent layer 12. In an embodiment, heat-flowable layer 28 can be a metal such as titanium, chromium, or aluminum, and can be deposited using physical vapor deposition (PVD) or chemical vapor deposition (CVD). Heat-flowable adhesive layer 28 can also be, for example, a thermoplastic polyimide such as Dupont™ ELJ. In an embodiment, heat-flowable layer 28 can bond with carbon and oxygen groups in a thermoplastic layer to form Ti—O—C bonds. The heat-flowable adhesive layer 28 can be used, for example, to bond a polyimide to another polyimide, or a polyimide layer to a metal layer using the laser lamination process described above.

In another embodiment, layer 28 is an uncured layer which is interposed between layer 10 and layer 12. Contact with laser beam 20 cures layer 28 such that layer 10 and layer 12 are physically bonded by cured layer 28. In this embodiment, layer 28 can be a UV curable adhesive which is cured by contact with a UV laser beam 20. In another embodiment, layer 28 can be a heat curable adhesive such as a liquid or paste which is heated and cured through contact with the laser beam 20.

In the FIG. 2 embodiments, neither layer 10 nor layer 12 is required to be a heat-flowable layer and thus these embodiments may allow a wider variety of materials to be selected for layer 10 and layer 12. For example, where two transparent layers are to be bonded together, an intermediate energy-absorbing layer can be interposed between the two transparent layers to effect a fluid-tight lamination. The energy-absorbing layer is a laser-curable layer, for example a UV-curable layer which can be cured using an ultraviolet laser or a heat-curable adhesive which can be cured using heat supplied by a laser beam.

Figure 3:
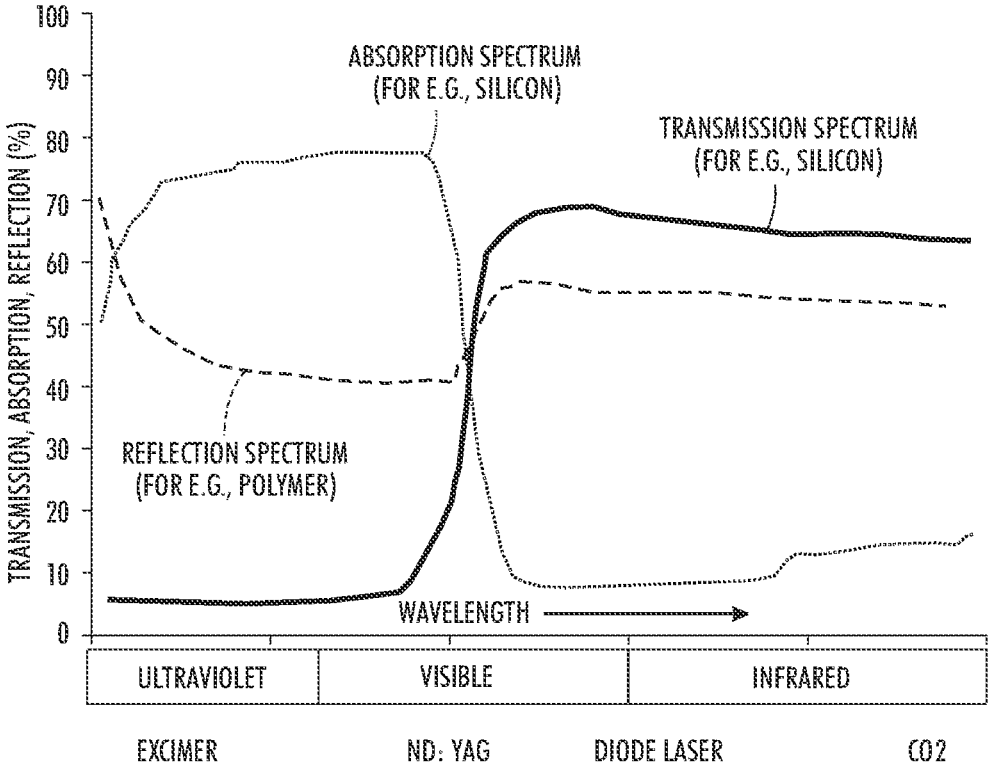
FIG. 3 is graph depicting various layer characteristics which can be examined to select a laser wavelength for laser bonding in accordance with the present teachings.

The type and specific wavelength of laser selected for the laser transmission bonding process described above depends on the specific characteristics of the materials to be bonded, such as the transmission spectrum, absorption spectrum, and reflection spectrum of the materials. FIG. 3 is a graph depicting absorption and transmission (transparency) for a silicon layer which can be used as a transparent layer, and reflection for a polymer layer which can be used as an absorbing layer. As described in FIG. 3, silicon generally absorbs ultraviolet energy and is generally transparent to infrared energy. Thus when a silicon layer is used as a transparent layer 12, the graph of FIG. 3 indicates that the silicon will be more transparent to a laser outputting a beam in the infrared wavelength than in the visible or ultraviolet spectrum.

To form a sufficient bond, the scanning speed of the laser beam can be balanced with various parameters, such as the absorption efficiency of the energy-absorbing layer, the melting point of the energy-absorbing layer and/or the transparent layer, and the power of the laser being used. For example, using identical material samples, a higher power laser can be scanned at a higher rate of speed than a lower power laser to achieve sufficient bonding. However, for a given scan speed, a higher power laser is more likely to damage the sample than a lower power laser, and thus must be scanned at a sufficiently high rate of speed to prevent damage to the materials. Additionally, laser scanning speed can be faster for a layer which has a high energy absorption than for a layer which has a low energy absorption, and can be faster for a layer which has a lower melting point.

To facilitate laser bonding, a surface of a layer such as a polyimide film, for example Upilex® available from Ube Industries or DuPont™ Kapton®, can be treated using various techniques to convert the surface to a thermoplastic, which can then be melted upon contact with a laser beam and used to adhere the polyimide film with another layer. For example, a polyimide film can be treated with an aqueous base solution, for example potassium hydroxide (KOH) or exposed to a plasma treatment to convert the inert polyimide film to polyamic acid to result in a thermoplastic surface. The polyimide surface which has been converted to thermoplastic may have a lower melting point than the original polyimide surface, and thus this converted surface is better suited for laser bonding than the untreated polyimide surface.

During laser transmission lamination, the layers to be bonded together can be held in close physical contact with each other to ensure a good bond. Because proper alignment between many printhead layers is critical, vision processing can be employed to align the various features. Since the laser itself uses light, this requirement is compatible with the need to see through the tooling. The transparent layer 12 can be, for example, a transparent glass or quartz layer. Further, lasers used for alignment tools can be in the infrared spectrum and thus silicon can be used as the transparent layer because, while not transparent to the visible spectrum, silicon is transparent to infrared laser light as indicated in FIG. 3

Various other embodiments of the present teachings are also contemplated. For example, several printhead layers forming the microfluidic channels (ink ports) require precision alignment, which can be difficult to achieve initially and more difficult to maintain as the aligned layers are placed into a stack press. Lateral forces exerted on aligned layers during the addition of stack press compliant pads and release lines on top of the parts to be bonded can cause a shift in the registration of the layers being bonded. Once the pads and release liners have been placed, the layers to be bonded are now hidden and misalignment caused by placement of the pads and release liners is difficult to detect. Additionally non-uniform pressure as the press plates descend upon the parts to be bonded can cause a shift in alignment, even though the parts may be gimbaled. Misalignment of the parts due to these factors can be reduced or eliminated if the parts are aligned and then temporarily tacked together using a laser bonding process described above to provide a plurality of spot welds prior to placing the assembly into the stack press or oven for the full cure. In this embodiment, the spot weld process does not provide a fluid-tight seal, but holds the layers in position while a conventional adhesive is being cured in a stack press or oven. The conventional adhesive can be precisely placed between the energy-absorbing layer and the transparent layer prior to tacking the two layers together with the plurality of spot welds. After tacking, the energy-absorbing layer and the transparent layer can be placed in a stack press or oven (collectively, a "curing fixture") to cure the conventional adhesive to provide a fluid-tight seal provided between various layers using the conventional adhesive.

Figure 4:
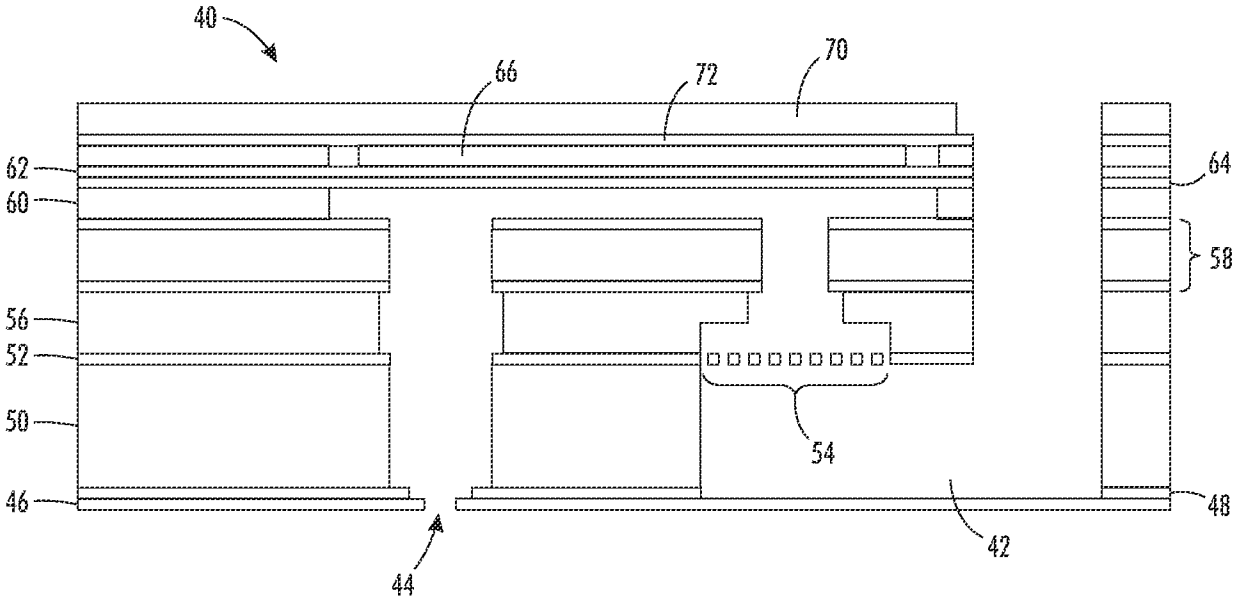
FIG. 4 is a cross section depicting a portion a printhead which can be formed using one or more embodiments of the present teachings.

FIG. 4 depicts a printer subassembly, and more particularly part of an ink jet printhead 40, which can be formed using one or more embodiments of the present teachings to laser bond two or more layers together. It will be understood that a printhead design can vary from the example depicted in FIG. 4. FIG. 4 generally depicts a single ink port 42 for the passage of ink to an aperture (nozzle) 44 within an aperture plate 46. An aperture plate adhesive 48 connects the aperture plate 46 to an inlet/outlet plate or manifold 50. A rock screen layer 52 including a rock screen (filter) 54 is interposed between the manifold 50 and a separator 56. FIG. 4 further depicts a vertical inlet 58 which can include a plurality of layers, a body plate 60, a diaphragm 62 attached to the body plate 60 with a diaphragm attach adhesive 64, piezoelectric actuator 66, a standoff layer 68, and a circuit layer 70 attached to the standoff layer 68 and the piezoelectric actuator 66 with an adhesive layer 72. A printhead structure can have hundreds or thousands of ink ports 42 and nozzles 44 within the aperture plate 46. It will be understood that two or more printhead layers can be physically attached to each other using an embodiment of the present teachings. For example, two layers can be physically connected without the use of a separate adhesive, for example using a process according to the FIG. 1 embodiment. In another embodiment, a separate adhesive layer can be formed by an embodiment of the laser bonding process as described with reference to, for example, in FIG. 2. Other variations are contemplated.

Figure 5:
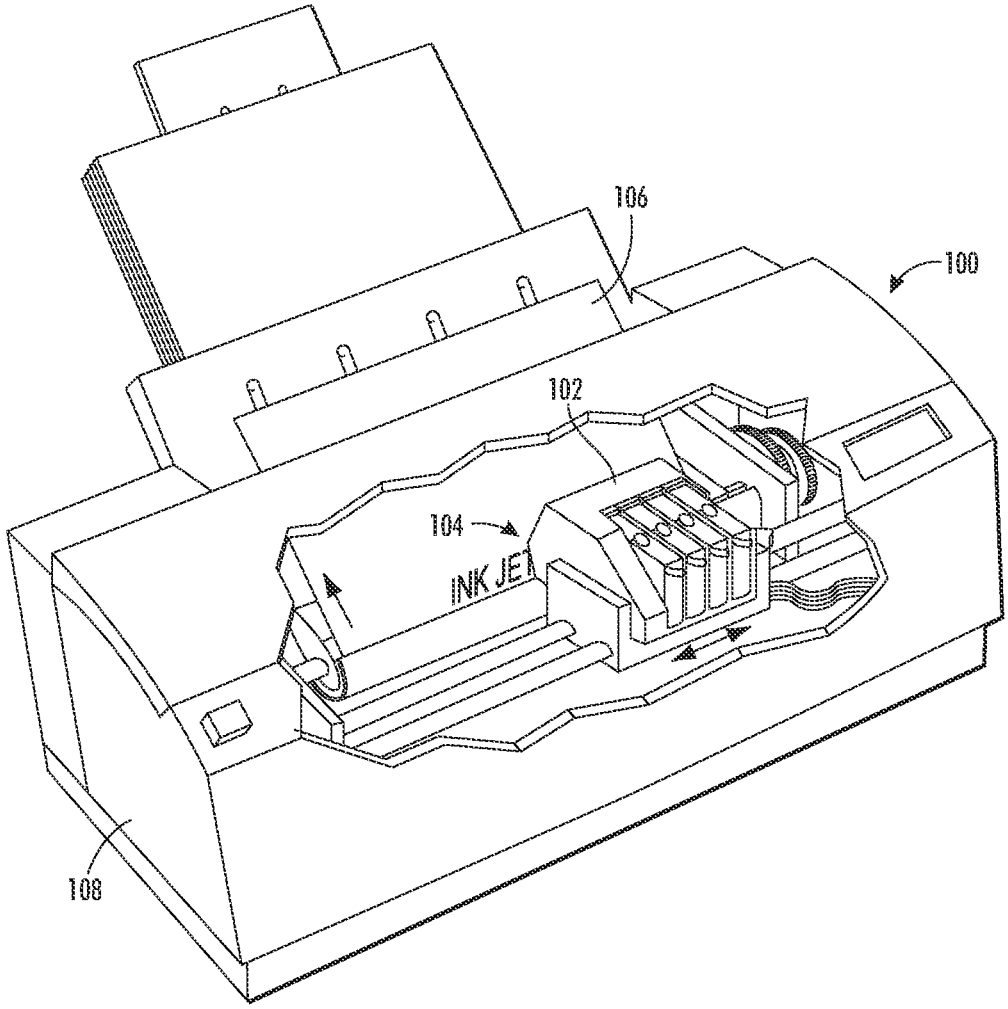
FIG. 5 is a is perspective view of a printer which can include a printhead formed in accordance with the present teachings.

Once manufacture of the printhead is completed, one or more printheads according to the present teachings can be installed in a printer. FIG. 5 depicts a printer 100 including one or more printheads 102 and ink 104 being ejected from one or more nozzles 44 in accordance with an embodiment of the present teachings. Each printhead 102 is configured to operate in accordance with digital instructions to create a desired image on a print medium 106 such as a paper sheet, plastic, etc. Each printhead 102 may move back and forth relative to the print medium 106 in a scanning motion to generate the printed image swath by swath. Alternately, the printhead 102 may be held fixed and the print medium 106 moved relative to it, creating an image as wide as the printhead 102 in a single pass. The printhead 102 can be narrower than, or as wide as, the print medium 106. The printer hardware including the printhead 102 can be enclosed in a printer housing 108. In another embodiment, the printhead 102 can print to an intermediate surface such as a rotating drum or belt (not depicted for simplicity) for subsequent transfer to a print medium.

Thus various embodiments of the present teachings can provide a fluid-tight seal for an ink jet printhead which has a reduced processing time. In contrast to an adhesive cure within a curing fixture, which can require two hours or more, laser bonding can require less than about two minutes, for example about 60 seconds. Additionally, the laser energy (i.e., bonding energy) is localized and thus the process of the present teachings can be less damaging to other structures such as silicon-based structures. Further, some embodiments do not require dispensing an adhesive and thus the number of required materials and problems caused by adhesive flowing into undesired locations can be reduced. Additionally, the laser bonding techniques described herein can be used to connect a wider variety of materials, for example materials which cannot be reliably attached using conventional adhesives.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for forming an ink jet printhead, comprising:

placing an energy-absorbing layer in physical contact with a transparent layer;

directing a laser beam through the transparent layer to contact the energy-absorbing layer with the laser beam; and curing at least one of the energy-absorbing layer and the transparent layer to physically attach the energy-absorbing layer to the transparent layer and to form at least a portion of an ink jet printhead.

2. The method of claim 1, further comprising:

directing the laser beam through the transparent layer to contact the energy-absorbing layer with the laser beam and to melt the energy-absorbing layer; and cooling the melted energy-absorbing layer to cure the energy-absorbing layer and to physically attach the energy-absorbing layer to the transparent layer.

3. The method of claim 1, further comprising:

directing the laser beam through the transparent layer to contact the energy-absorbing layer with the laser beam to heat the energy-absorbing layer;

melting the transparent layer using heat transferred from the energy-absorbing layer through physical contact between the energy-absorbing layer and the transparent layer; and cooling the melted transparent layer to cure the transparent layer and to physically attach the energy-absorbing layer to the transparent layer.

4. The method of claim 1 wherein the energy-absorbing layer is a heat-flowable layer and the method further comprises:

placing an underlying layer in contact with the heat-flowable layer such the heat-flowable layer is interposed between and contacts the transparent layer and the underlying layer;

directing the laser beam through the transparent layer to melt the heat-flowable layer; and cooling the heat-flowable layer to cure the heat-flowable to physically attach the transparent layer to the underlying layer with the heat-flowable layer.

5. The method of claim 1 wherein the energy-absorbing layer is a laser-curable layer and the method further comprises:

placing an underlying layer in contact with the laser-curable layer such that the laser-curable layer is interposed between and contacts the transparent layer and the underlying layer; and directing the laser beam through the transparent layer to cure the laser-curable layer with the laser beam to physically attach the transparent layer to the underlying layer with the laser-curable layer.

6. The method of claim 1, further comprising:

selecting a wavelength for the laser beam; and selecting the transparent layer based on the wavelength of the laser beam, wherein the transparent layer comprises at least one pigment which enhances the transparency of the transparent layer to the selected laser beam wavelength.

7. The method of claim 1, further comprising:

selecting a wavelength for the laser beam; and selecting the energy-absorbing layer based on the wavelength of the laser beam, wherein the energy-absorbing layer comprises at least one pigment or dye which enhances energy absorption of the energy-absorbing layer to the selected laser beam wavelength.

8. The method of claim 1, wherein the energy-absorbing layer is a polyimide film and the method further comprises:

treating a surface of the polyimide film to convert the surface to a thermoplastic;

physically contacting the transparent layer and the thermoplastic surface;

directing the laser beam through the transparent layer to contact the thermoplastic surface with the laser beam to heat and melt the thermoplastic surface; and cooling the thermoplastic surface to cure the thermoplastic surface to physically attach the polyimide film to the transparent layer using the thermoplastic surface.

9. The method of claim 1, further comprising:

scanning the laser beam while directing the laser beam through the transparent layer to contact the energy-absorbing layer with the laser beam during the scanning; and providing a fluid-tight seal between the energy-absorbing layer and the transparent layer using the cured at least one energy-absorbing layer and the transparent layer.

10. The method of claim 1, further comprising:

placing an adhesive between the energy-absorbing layer and the transparent layer, providing a plurality of spot welds while directing the laser beam through the transparent layer to contact the energy-absorbing layer with the laser beam during the scanning, wherein the plurality of spot welds tacks the energy-absorbing layer to the transparent layer;

subsequent to providing the plurality of spot welds, placing the energy-absorbing layer and the transparent layer into a curing fixture; and curing the adhesive within the curing fixture, wherein a fluid-tight seal is provided between the energy-absorbing layer and the transparent layer using the cured adhesive.

* * * * *